United States Patent [19]

Roche

[11] Patent Number: 4,500,812

[45] Date of Patent: Feb. 19, 1985

[54] ELECTRONIC BALLAST CIRCUIT

[75] Inventor: William J. Roche, Merrimac, Mass.

[73] Assignee: GTE Products Corporation, Stamford, Conn.

[21] Appl. No.: 466,247

[22] Filed: Feb. 14, 1983

[51] Int. Cl.[3] ..... H05B 37/00

[52] U.S. Cl. ..... 315/171; 315/173; 315/205; 315/240; 315/241 R

[58] Field of Search ..... 315/205, 240, 241, 171, 315/173; 363/46, 60, 61

[56] References Cited

U.S. PATENT DOCUMENTS 3,670,230 6/1972 Rooney ..... 363/46
3,787,751 1/1974 Farrow ..... 315/205
4,042,856 8/1977 Steigerwald ..... 315/205
4,109,307 8/1978 Knoll ..... 363/101

*Primary Examiner*—Harold Dixon
*Attorney, Agent, or Firm*—Thomas H. Buffton

[57] ABSTRACT

An electronic ballast circuit for a lower pressure lamp wherein a voltage divider network coupled by a capacitor and directly coupled to an AC source is shunted by a series connected transistor switch and capacitor filter, and the switch is coupled by a diode to a lamp while a ballast resistor couples the filter capacitor to the lamp. A starter network device includes a glo-bottle starter which couples a transistor switch to the lamp with a resistor coupled to the glo-bottle starter and the transistor switch.

13 Claims, 9 Drawing Figures

ELECTRONIC BALLAST CIRCUIT

TECHNICAL FIELD

This invention relates to ballast circuits for lamps and more particularly to electronic ballast circuits suitable for use with fluorescent lamps.

BACKGROUND ART

Ballast circuits for fluorescent lamps are most commonly in the form of a coil/core construction suitable for operation at low frequencies. Recently, electronic ballasts employing much higher frequencies have been designed and employed in various commercial, industrial and residential applications. These recent electronic ballasts offer greatly improved efficiency while providing such capability with structures of reduced size and weight.

Unfortunately, these newer electronic ballasts suffer from disadvantages. Primarily the cost of the newer electronic ballasts has increased considerably over prior known structures. Moreover, this undesired increased cost appears to be directly related to an increase in component count which is, in turn, caused by circuitry which converts a low frequency AC supply voltage to a direct current (DC) voltage and again to a high frequency voltage for application to the lamp. Obviously, such multiple conversion is deleterious to a cost effective structure.

One known technique for operating fluorescent lamps without a ballast arrangement is set forth in U.S. Pat. No. 3,771,013 issued to Roche et al on Nov. 15, 1973 and assigned to the assignee of the present application. Herein, a saturated transistor amplifier is utilized to prevent the peak operating current of the lamp from exceeding a predetermined maximum level. However, a problem was found to exist in that the filter capacitor employed had to have a voltage rating equal to the supply voltage multiplied by the $\sqrt{2}$, even though a voltage of such a magnitude is experienced only during the starting period or at the end of life of the fluorescent lamp. Moreover, the voltage experienced by the filter capacitor is much lower during the operational life of the fluorescent lamp. Thus, a filter capacitor having a maximum voltage rating of a value which exists only during the starting and end of life of the fluorescent lamp appears to be needlessly excessive in size and in cost.

OBJECTS AND SUMMARY OF THE INVENTION

An object of the present invention is to provide an enhanced electronic ballast circuit. Another object of the invention is to provide an improved electronic ballast which is of a reduced cost and smaller size than other known electronic ballasts for fluorescent lamps. Still another object of the invention is to reduce cost and circuit complexity while providing increased efficiency over conventional high frequency electronic ballasts.

These and other objects, advantages and capabilities are achieved in one aspect of the invention by an electronic ballast circuit having a voltage divider network wherein a series connected switch and filter are coupled to a rectifier which is coupled directly and by a capacitor to a potential source, a starter network coupled to the potential source, to the junction of the switch and rectifier and to a fluorescent lamp, a diode coupling the switch to the lamp and a ballast coupling the filter to the lamp.

In another aspect of the invention, circuitry is provided for converting an AC potential to a DC potential and applying this DC potential to a filter and to a lamp for effecting operation thereof. Also, apparatus is provided for converting a source voltage to a voltage of an amount sufficient to effect starting of a fluorescent lamp. Moreover, starting and operating of the fluorescent lamp is effected by a single AC to DC signal conversion capability.

BEST MODE FOR CARRYING OUT THE INVENTION

For a better understanding of the present invention, together with other and further objects, advantages, and capabilities thereof, reference is made to the following disclosure and appended claims in conjunction with the accompanying drawings.

Figure 1:
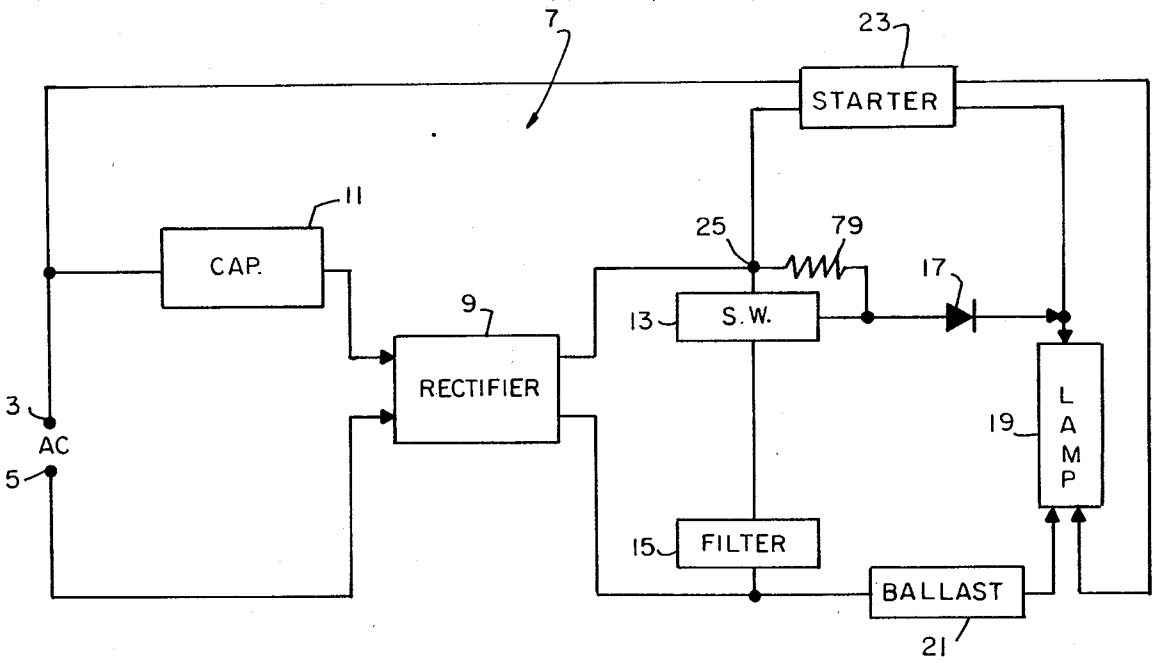
FIG. 1 is a block diagram of a preferred form of electronic ballast circuit.

Referring to the drawings, FIG. 1 illustrates, in block form, a preferred electronic ballast circuit of the invention. Herein, a pair of terminals, 3 and 5, are formed for connection to an AC service voltage source, such as a 220-volt 50 Hz potential source for example. A voltage divider network 7 includes a full-wave rectifier 9 which is coupled by a capacitor 11 to one terminal 3 of the pair of terminals 3 and 5 and directly coupled to the other terminal 5. Also, the network 7 has a semiconductor switch 13 in series connection with a filter 15 and the switch 13 and filter 15 are coupled to the full-wave rectifier 9.

Further, the semiconductor switch 13 is coupled by a unidirectional conduction device 17 to a fluorescent lamp 19 while the filter 15 is coupled to a ballast 21 to the fluorescent lamp 19. A starter network 23 couples the fluorescent lamp 19 and a junction 25 of the rectifier 9 and semiconductor switch 13 to a terminal 3 of the pair of terminals 3 and 5 formed for connection to the AC service voltage source. A bias resistor 79 couples junction 25 of the rectifier 19 and semiconductor switch 13 to the unidirectional conduction device 17.

Figure 2:
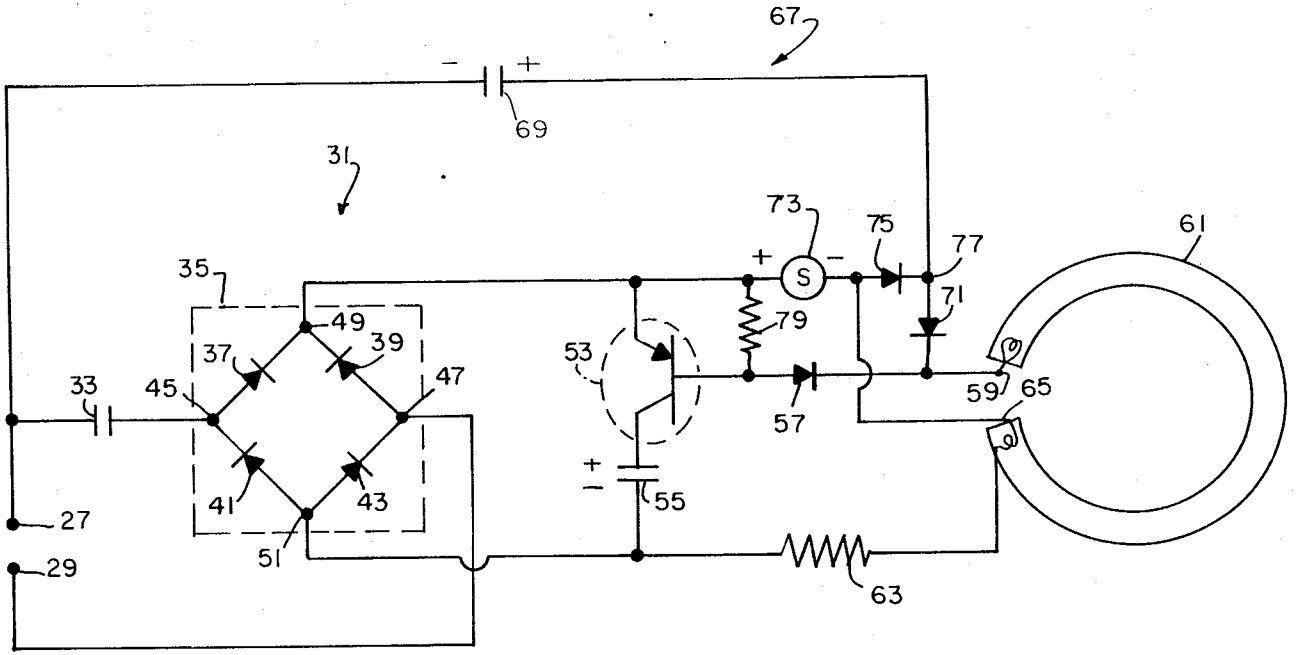
FIG. 2 is a schematic illustration of the preferred form of electronic ballast circuitry of FIG. 1.

More specifically, the schematic illustration of FIG. 2 sets forth an electronic ballast circuit of the invention having a pair of terminals 27 and 29 formed for connection to an AC potential source. A voltage divider network 31 includes a divider capacitor 33 which is coupled to one terminal 27 of the pair of terminals 27 and 29 formed for connection to the AC potential source. A full-wave rectifier 35 includes four-diodes, 37, 39, 41, and 43 respectively, connected in a bridge configuration. A junction 45 of two of the diodes 37 and 41 is connected to the voltage divider capacitor 33. A junction 47 of another two diodes 39 and 43 is directly connected to the other terminal 29 formed for connection to the AC service voltage source. Also, the junctions 49 of the diodes 37 and 39 and the junction 51 of the diodes 41 and 43 are connected to a transistor switch 53 and a filter 55 respectively which are in series connection with one another.

A unidirectional conduction device or diode 57 couples the transistor switch 53 to one electrode 59 of the fluorescent lamp 61, such as a circline FC6T9 lamp manufactured by GTE Sylvania for example. Also, a resistor ballast 63 couples the filter capacitor 55 to the other electrode 65 of the fluorescent lamp 61.

Additionally, a lamp starting network 67 includes a starting capacitor 69 in series connection with a second diode 71 and coupling the one terminal 27, formed for connection to the AC potential source, to the one electrode 59 of the fluorescent lamp 61. A glo-bottle starter 73, of a type well-known in the art, and a third diode 75 are series connected intermediate the transistor switch 53 and a junction 77 of the starting capacitor 69 and the second diode 71. Moreover, a bias resistor 79 couples the junction of the transistor switch 53 and glo-bottle starter 73 to the junction of the transistor switch 53 and the diode 57.

Figure 3:
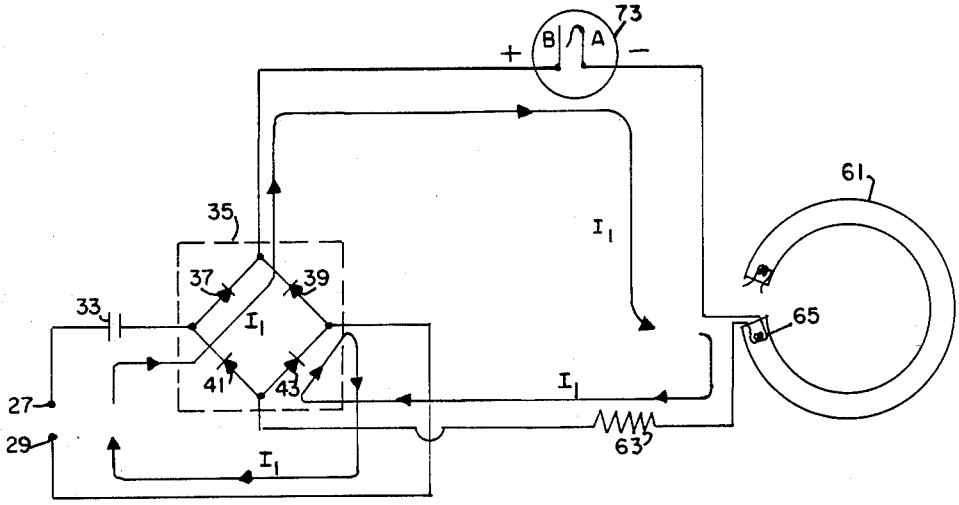
FIGS. 3–9 are partial schematics of FIG. 2 illustrating operation of the circuitry of FIG. 2.

As to operation, reference is made to the simplified illustration of FIG. 3 which depicts circuit conditions prior to lamp starting and during a half-cycle of the voltage available from an AC voltage source available at the terminals 27 and 29. A current $I_1$, indicated by flow line, progresses on a path starting with the AC supply voltage terminal 27 and continuing to the capacitor 33, diode 37, a glow starter 73, a second electrode 65 of the lamp 61, a ballast 63, a diode 43 and the other terminal 29 of the AC voltage source. This current $I_1$ establishes a glow discharge in the glow starter 73 which heats a bimetal switch element "A" causing it to deflect and contact a fixed contact "B" to provide a closed starter circuit.

Figure 4:
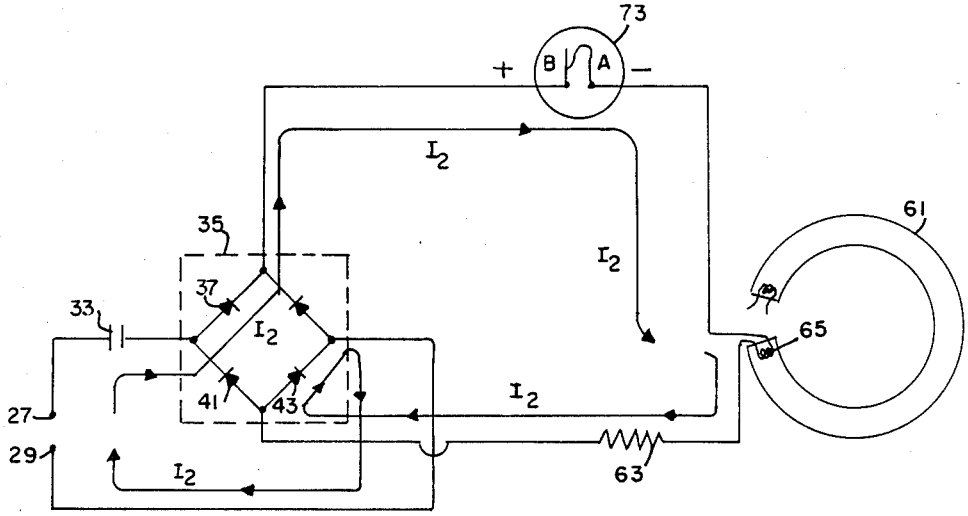

FIG. 4 illustrates a simplified circuit of the above-mentioned closed starter circuit condition wherein fluorescent lamp preheat current $I_2$ flows in the circuit for a half-cycle of the AC supply voltage. This preheat current $I_2$ is typically an order of magnitude greater than the initial current $I_1$ and thereby sufficient to heat the electrode 65 of the fluorescent lamp 61 to a proper temperature for starting. Specifically, the preheat current $I_2$ has a path which includes terminal 27, capacitor 33, diode 37, glow starter 73, the electrode 65, ballast 63, diode 43 and back to the other terminal 29 of the AC voltage source.

Figure 5:
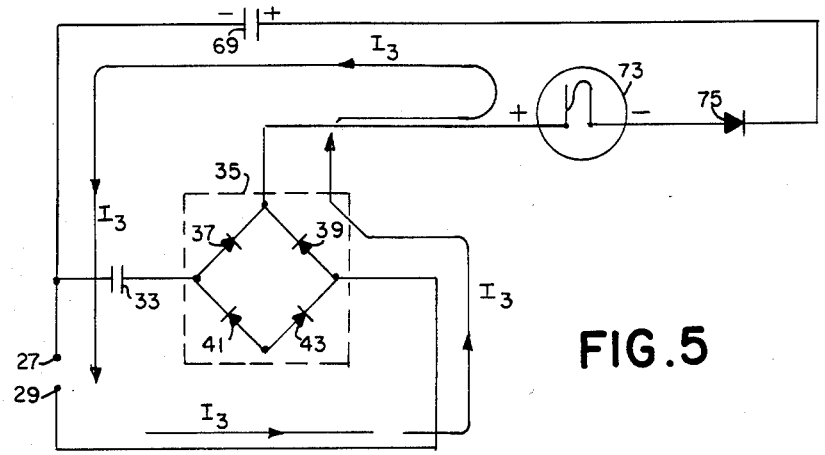

Concurrent with the establishment of the above-mentioned preheat current $I_2$ a capacitor charging current $I_3$ is initiated. This capacitor charging current $I_3$ is illustrated in the simplified circuit of FIG. 5 with the flow path starting at the AC terminal 29 and progressing through the diode 39 glow starter 73, a second diode 75, a capacitor 69 of a voltage doubler circuit means and the terminal 27. Thus, the voltage developed across the lamp starter capacitor 69 as a result of the capacitor charging current $I_3$ will be substantially equal to the $\sqrt{2}$ Vac where Vac is the VMS value of the AC voltage source.

Figure 6:
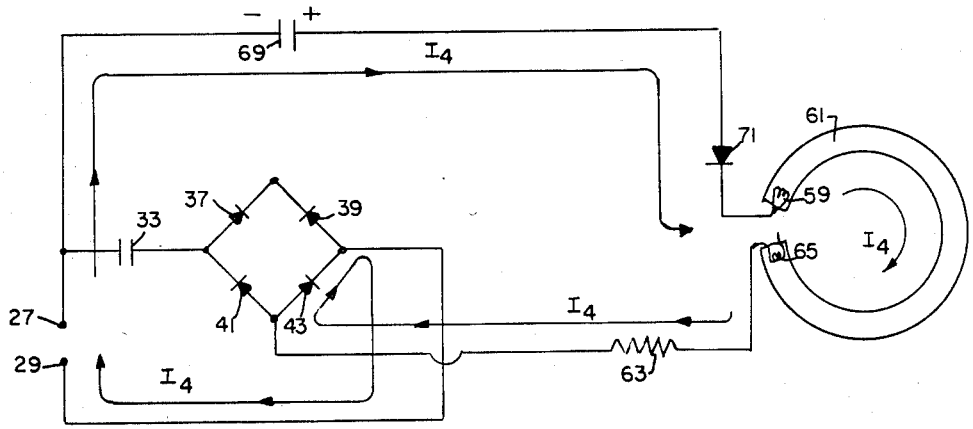

During the electrode preheat phase (FIG. 4) of lamp starting, the contacts of the glow bottle 73 will cool causing separation thereof and cessation of the electrode preheat current $I_2$ and the capacitor charging current $I_3$. Thereupon, conditions exist, as depicted in the schematic illustration of FIG. 6, wherein the starting capacitor 69 discharges through the fluorescent lamp 61 resulting in low current level conduction between the lamp electrodes 59 and 65 respectively. This discharge voltage, driving a discharge current $I_4$ of FIG. 6, is a summation of the voltage across the capacitor 69 of the voltage doubler circuitry and the AC voltage supplied at the terminals 27 and 29. This discharge voltage will have a maximum value of about $2\sqrt{2}$ Vac when the polarity of the AC supply voltage is such that terminal 27 is positive with respect to terminal 29. Thus, the path for the discharge current $I_4$ includes terminal 27 of the voltage supply, capacitor 69, first diode 71, electrodes 59 and 65 of the fluorescent lamp 61, the ballast 63, diode 43 and the other terminal 29 of the AC voltage source.

Figure 7:
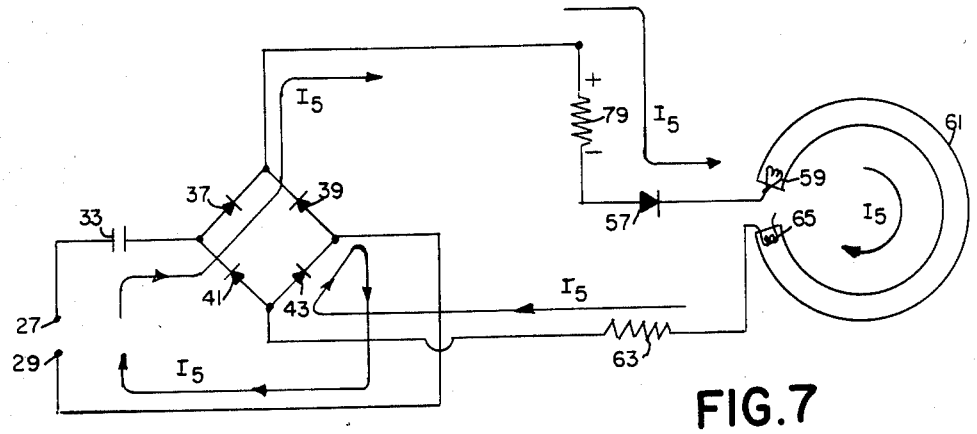

Once conduction in the fluorescent lamp 61 has been established via the starting capacitor 69, primary lamp current $I_5$ flows as depicted in the simplified illustration of FIG. 7. As shown for one-half cycle of the AC supply voltage, primary lamp current $I_5$ originates at the AC voltage terminal 27 and proceeds through capacitor 33, diode 37, bias resistor 79, a third diode 57, the fluorescent lamp 61, ballast 63, diode 43 and the other AC voltage source terminal 29. Moreover, this primary lamp current $I_5$ will continue to flow until such time as the AC supply voltage falls below the operational lamp voltage.

Figure 8:
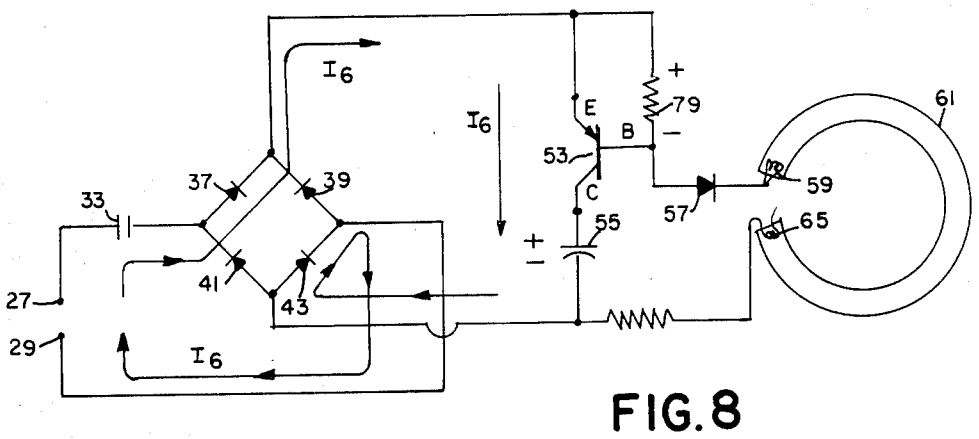

At the same time as the primary lamp current $I_5$ is established, an auxiliary capacitor charging current $I_6$ is initiated. As indicated in FIG. 8 for one-half cycle of the AC supply voltage, the primary lamp current $I_5$ flowing through the switch bias resistor 79 serves to forward bias the emitter-base terminals of the switching transistor 53 thereby causing the transistor 53 to saturate and allow the capacitor charging current $I_6$ to pass from emitter to collector of transistor 53 and charge the auxiliary voltage source capacitor 55. As illustrated, the capacitor charging current $I_6$ originates at the AC supply voltage terminal 27 and proceeds through the capacitor 33, diode 37, transistor 53, auxiliary charge capacitor 55, diode 43 and ends at the other voltage terminal 29.

Figure 9:
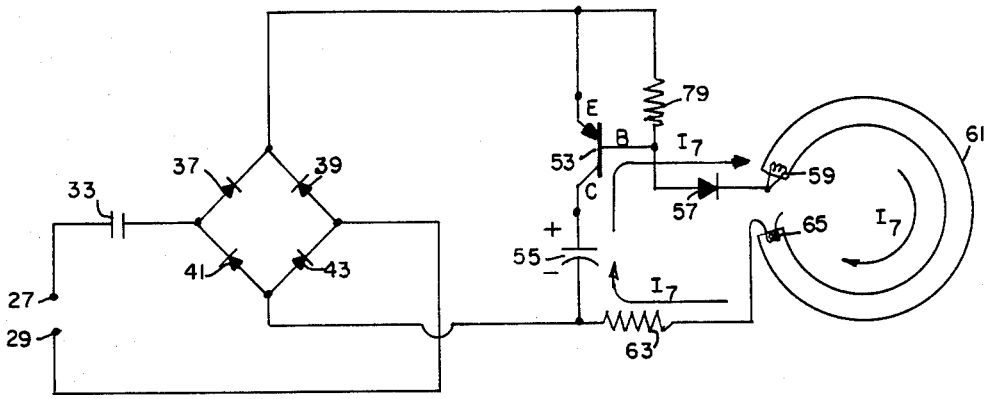

So long as the instantaneous value of the AC supply voltage is equal to the voltage on the auxiliary voltage supply capacitor 55, which is the lamp voltage, the charge current $I_6$ will continue to flow. When this instantaneous value of the AC supply voltage falls below this voltage of the supply capacitor 55 the switch transistor 53 is no longer forward biased causing cessation of the capacitor charging current $I_6$. However, the collector-base of the transistor 53 now becomes forward biased allowing capacitor 55 to discharge, $I_7$ of FIG. 9, its stored energy through the lamp 61. Specifically, the capacitor 55 discharges through the collector-base of the switch transistor 53, third diode 57, lamp 61, the ballast 63 and ending at the capacitor 55.

Accordingly, energy is continuously supplied to the fluorescent lamp 61 during the time period when the instantaneous value of the AC supply voltage is lower than the voltage of the fluorescent lamp. Thus, the unique charge and discharge circuitry for the auxiliary voltage supply capacitor 55 permits the use of a capacitor having a relatively low voltage rating as compared with prior known capacitors.

However, prior known circuitry required a filter capacitor 55 having a voltage rating greatly in excess of the service or supply voltage. For example, known circuitry required a capacitor 55 having a voltage rating which not only exceeded the supply voltage multiplied by the $\sqrt{2}$ but also usually allowed for an added 10% higher line voltage and a 20% safety factor. Thus, it was not uncommon to employ a capacitor 55 having a voltage rating of about 400 volts when supplied from a 220-volt AC source. Unfortunately, such voltage appears at the capacitor 55 only during lamp starting and at the end of lamp life. During normal lamp operation the operational voltage appearing at the capacitor 55 is something less than about 150 volts. Thus, a capacitor 55 having a rating based upon a maximum voltage applied, 400 volts for example, is excessive in size and cost when operational conditions are considered.

Such undesired conditions are avoided by the circuitry of FIG. 2 employing the transistor switch 53 and associated resistor 79. After lamp current has been established, to be explained hereinafter, the filter capacitor 55 is charged by way of the voltage source, the voltage divider capacitor 33, the rectifier 35, the resistor 79, diode 57, lamp 61 and ballast resistor 63. The resulting voltage developed across the resistor 79 turns on or renders conductive the transistor switch 53 allowing the filter capacitor 55 to charge to the approximate level of the lamp voltage. Thus, the filter capacitor 55 charges by way of the divider capacitor 33, rectifier 35 and transistor switch 53 and discharges through the collector-base junction of the transistor switch 53, diode 57, lamp 61 and ballast resistor 63. In this manner, energy is supplied to the fluorescent lamp 61 whenever the potential from the voltage supply falls below the lamp voltage.

As to the previously mentioned establishment of lamp current, a supply or service voltage appearing at the terminals 27 and 29 is applied to the glo-bottle starter 73 by way of the divider capacitor 33, the rectifier 35, the ballast resistor 63 and the filament 65 of the fluorescent lamp 61. Upon closure of the glo-bottle starter 73 to establish preheat current, the starting capacitor 69 is charged by way of the potential at the terminals 27 and 29, the rectifier 35, glo-bottle starter 73 and third diode 75. Upon opening of the glo-bottle starter 73 after an appropriate preheating interval, the voltage across the starting capacitor 69 adds with the source or supply voltage to form a voltage doubler circuit whereby the fluorescent lamp 61 is ionized via the voltage supply, starting capacitor 69, second diode 71, resistor ballast 63 and the rectifier 35. Moreover, the starter circuit network 67 becomes dormant once the lamp is ionized.

Thus, circuitry has been provided having lower cost, less complexity and higher efficiency than other known conventional ballast circuits. Not only can the capacitor 55 be of reduced size and voltage ratings, but the ballast resistor 63 may be a small inexpensive component as compared with prior known transistors and large, expensive and heavy inductance units.

While there has been shown and described what is at present considered the preferred embodiments of the invention, it will be obvious to those skilled in the art that various changes and modifications may be made therein without departing from the invention as defined by the appended claims.

What is claimed is:

1. An electronic ballast circuit for a fluorescent lamp comprising:

a voltage divider network including a series-connected capacitor and rectifier means formed for connection to an AC voltage source;

starter circuit means including a capacitor coupled to a voltage source and to a first electrode of said fluorescent lamp and a glow starter means coupled to said rectifier means and to said first electrode of said fluorescent lamp;

ballast means coupled to said rectifier means and to a second electrode of said fluorescent lamp; and auxiliary voltage means including a series connected switch and storage capacitor shunting said rectifier with a switch bias resistor coupled to the junction of said rectifier means and glow starter means and to the junction of said switch and first electrode of said fluorescent lamp whereby said storage capacitor is charged during operation of said fluorescent lamp.

2. The electronic ballast circuit of claim 1 wherein said rectifier means is in the form of a full-wave bridge-type rectifier.

3. The electronic ballast circuit of claim 1 wherein said storage capacitor of said auxiliary voltage means is of a voltage rating substantially equal to the operational voltage of said fluorescent lamp.

4. The electronic ballast circuit of claim 1 wherein said ballast means is in the form of a resistor.

5. The electronic ballast circuit of claim 1 wherein said switch of said auxiliary voltage means is in the form of a semi-conductor device.

6. The electronic ballast circuit of claim 1 wherein said switch of said auxiliary voltage means is in the form of a transistor.

7. The electronic ballast circuit of claim 1 wherein said starter circuit means includes a first diode connected to said capacitor and to said first electrode of said fluorescent lamp.

8. The electronic ballast circuit of claim 1 wherein said starter circuit means includes a first diode connected to said capacitor and to said first electrode of said fluorescent lamp and a second diode connected to said glow starter means and to the junction of said capacitor and first diode.

9. The electronic ballast circuit of claim 1 wherein said auxiliary voltage means includes a third diode connected to the junction of said bias resistor and switch and to said first electrode of said fluorescent lamp.

10. A fluorescent lamp electronic ballast circuit comprising:

means coupled to an AC voltage source for developing a DC potential;

starter circuit means including a voltage doubler circuit coupled to said AC voltage source and to said means for developing a DC potential and to said fluorescent lamp and a glow starter means coupled to said means for developing a DC potential and to said fluorescent lamp;

auxiliary voltage means including a series connected switch and storage capacitor coupled to said means for developing a DC potential and a bias means coupled to the junction of said means for developing a DC potential and said glow starter means and to the junction of said switch and said fluorescent lamp; and ballast means coupled to said means for developing a DC potential to said fluorescent lamp whereby an AC voltage is converted to a DC potential and applied to said fluorescent lamp.

11. The electronic ballast circuit of claim 10 wherein said means for developing a DC potential is in the form of a voltage divider having a series connected capacitor and bridge-type rectifier connectable to an AC voltage source and said starter circuit means includes a series-connected capacitor and first diode connected to the junction of said AC voltage source and capacitor and to said fluorescent lamp to form a voltage doubler circuit.

12. The electronic ballast circuit of claim 11 wherein said glow starter means includes a series-connected glow starter and second diode with said glow starter connected to said means for developing a DC potential and said second diode connected to the junction of said series-connected capacitor and first diode.

13. The electronic ballast circuit of claim 10 wherein said auxiliary voltage means includes a third diode coupled to the junction of said switch bias resistor and switch and to said fluorescent lamp.

* * * * *